US006102401A

United States Patent [19]

Segman et al.

[11] Patent Number: 6,102,401

[45] Date of Patent: Aug. 15, 2000

[54] GAME OF NUMBERS AND COLORS

[76] Inventors: Yosef Segman, 28 Hamada Str., Zichron Yaacov; David Solomon, Tal El, Western Galili, both of Israel

[21] Appl. No.: 09/179,828

[22] Filed: Oct. 28, 1998

[51] Int. Cl.[7] ..... A63F 1/00

[52] U.S. Cl. ..... 273/272; 273/299; 434/207

[58] Field of Search ..... 273/272, 299, 273/302; 434/129, 188, 191, 196, 207, 208, 209

[56] References Cited

U.S. PATENT DOCUMENTS

| | | | |
|---|---|---|---|
| 4,333,656 | 6/1982 | Sommer | 273/299 |
| 4,826,175 | 5/1989 | Quatrino | 273/299 |
| 4,877,255 | 10/1989 | Von Braunhut | 273/299 |
| 5,242,171 | 9/1993 | Hata | 434/191 |
| 5,314,190 | 5/1994 | Lyons | 273/272 |
| 5,417,425 | 5/1995 | Blumberg et al. . | |
| 5,868,393 | 2/1999 | Williams | 434/191 |

OTHER PUBLICATIONS

Scarne's Complete Guide to Gambling, "Gin Rummy" (New York:Simon and Schuster), pp. 599–603, 1961.

*Primary Examiner*—William M. Pierce

*Attorney, Agent, or Firm*—Mark L. Friedman

[57] ABSTRACT

A method of playing a game of numbers and colors. In this game method, a new higher level of player strategy is introduced by way of players privately possessing numbered and colored objects for the duration of the game, in contrast to existing mathematical or color game methods based on utilizing sets of cards or objects viewed by all players. The present invention includes a new method of simultaneously combining mathematical operations performed on both numbers and colors. The method of the game of numbers and colors is based on utilizing the mathematical operations of multiplication, division, addition, or subtraction of numbers, and is also based on application of linear combinations of at least two colors to produce another different color. Emphasis is on mathematical manipulation of prime and non-prime numbers. Colors used in the method of the game are not limited to any finite number. The method of playing a game of numbers and colors of the present invention can be implemented in alternative formats or media, for example, based on the use of cards, tokens, or a computer. Playing the game of numbers and colors simultaneously amuses and educates participants with respect to number and color combinations and serves as a new addition to currently existing games based on subjects of mathematics and color.

15 Claims, 3 Drawing Sheets

(a)

(c)

front (b)

back (d)

GAME OF NUMBERS AND COLORS

FIELD AND BACKGROUND OF THE INVENTION

The present invention relates to games, and more particularly to a method of playing a game of numbers and colors.

Games are primarily for amusement of adults and children. The amusement factor is based on a combination of social interaction and the competitive element required to play a game, for those games having more than one participant. Games based on solitaire participation contain the competitive element without need for social interaction; as is well known, such games can be extremely amusing to the solitaire player. Another valuable purpose of games is to teach something to adults or children, in a form more amenable to the educational process, compared to learning something from a blackboard or textbook. Often, a sign of a successful and popular game is one that fulfills both these purposes at the same time, i.e., an amusing and educational game.

The principle mechanics or method of any game is based on: 1) preliminary general information about the subject of the game and game hardware, including alternative formats or modes of playing the game, and objects, equipment, or media required for playing the game (e.g., cards, dice, chips, tokens, game board, number or object spinner, computer, etc.), required number of players, typical time duration of play, etc., 2) a detailed set of rules and step-by-step procedures specifying a competition, including the permissible actions of and information available to each participant, 3) the criteria for termination of the competition, typically based on completion of specific tasks, an accumulation of a pre-set number of points, or attainment of a score, and 4) distribution of payoffs, if applicable. Often, game mechanics includes information relating to the probabilities with which chance events may occur, since an important property of nearly every game involves the occurrence of chance or random events.

Games can be devised for essentially any subject matter. A mathematical game indicates that the mechanics is based on utilizing mathematical operations, including addition, subtraction, multiplication, and/or division of numbers for completion of specific tasks, leading to accumulation of points or attainment of a score. A mathematical game may involve one or more different categories of numbers, including for example, numbers which are whole integers, rational, prime, non-prime, real, imaginary, etc.

A game can also be based on colors, whereby the game mechanics involves manipulation of symbols of light and image perception for completion of game tasks. A game based on colors may also involve mathematical operations to be performed on colors analogous to mathematical operations performed on numbers. Essentially, formation of a basic color from a linear combination of other basic colors is analogous to application of the mathematical operations of addition and subtraction to colors. For example, applying the operation of addition on appropriate shades of at least two colors (e.g., green and red), results in another different color (i.e., yellow).

An extensive variety of games based on mathematics or color are available. However, few game methods feature mathematical operations of prime numbers, or mathematical operations of colors, in the main objective of play. Moreover, a method of playing a game which includes a method of simultaneously combining mathematical operations performed on prime numbers and colors has not been identified in the prior art.

An example of a mathematical game method featuring multiplication (i.e., as the only mathematical operation in the game method) in the main objective of play is 'Find The Products' (*Math Card Games—Games for Learning and Enjoying Math*, second edition, Cotter, Joan A., Activities For Learning, Hutchinson, Minn., USA, 1988), a card game, whereby the main object is for a player to collect the most product cards by pairing cards in his hand, using a card set previously distributed to that player, with a product equal to that of a card already on the table (i.e., viewable by all players). 'Find The Products' game is specified as a card game, does not emphasis number categories (e.g., prime or non-prime numbers), and it involves no colors. Moreover, the game restricts players to form products of numbers using number cards previously set out on the table (i.e., viewable by all players), in contrast to players forming products of numbers using number cards possessed by a particular player (i.e., not viewable by all players).

Another example of a mathematical game method is one which features multiplication of prime and non-prime numbers, 'Factoring' (*Math Card Games—Games for Learning and Enjoying Math*, second edition, Cotter, Joan A., Activities For Learning, Hutchinson, Minn., USA, 1988), another card game, whereby the main object is for a player to collect the most product cards by completing rows of cards previously set out on the table, each row containing a non-prime number product card and a variable quantity of prime number cards, by using a set of cards previously distributed to that player. In each completed row, the number on the product card must equal the product of the prime number cards. As for 'Find The Products' game, The 'Factoring' game is similarly restrictive with respect to player interaction, in that players are required to form products of numbers using number cards previously set out on the table (i.e., viewable by all players), in contrast to a more flexible alternative method of play, whereby players form products of numbers using number cards possessed by a particular player (i.e., viewable by all players). Moreover, the 'Factoring' game is restricted to multiplication of prime and non-prime numbers, and it involves no colors.

SUMMARY OF THE INVENTION

The present invention relates to a method of playing a game of numbers and colors. The mechanics, or method, of the game of numbers and colors is based on utilizing the mathematical operations of multiplication, division, addition, or subtraction of numbers, and is also based on application of linear combinations, such as addition and subtraction, on at least two colors to produce another different color. Players form series of objects featuring numbers and/or colors, by combining numerical and/or color based objects privately possessed by the player with numerical and/or color based objects accessible to all players. Categories of numbers used in the method of the game of numbers and colors in the present invention include, but are not limited to, real, whole integer, rational, prime, and non-prime numbers. Colors used in the method of the game of numbers and colors in the present invention include, but are not limited to, red, green, blue, white, cyan, magenta, yellow, and black.

According to the present invention, there is provided a method of playing a game with at least one player, the method comprising the steps of: (a) providing at least three objects, each object featuring a color; (b) distributing at least three objects to the at least one player; (c) attempting to form a color object series according to the colors of the at least three objects, wherein the color object series is formed such that a first object features a color resulting from a linear combination of colors of a remainder of the at least three objects of the color object series; and (d) crediting the at least one player if the color object series is formed.

According to the present invention, there is provided a method of playing a game with at least one player, the method comprising the steps of: (a) providing a plurality of objects, each object featuring a number; (b) distributing at least three objects to the at least one player; (c) attempting to form a numerical multiplication and division object series according to the numbers of the at least three objects, wherein the numerical multiplication and division object series is formed such that a first object features a non-prime number and each object of a remainder of the at least three objects features a prime number or a fraction of a prime number, whereby the non-prime number of the first object is formed by multiplying or dividing the numbers of the objects of the remainder of the at least three objects of the numerical multiplication and division object series; (d) alternatively, if the numerical multiplication and division object series cannot be formed, attempting to form a numerical addition and subtraction object series according to the numbers of the at least three objects, wherein the numerical addition and subtraction object series is formed such that a first object features a number and each object of a remainder of the at least three objects features a number, whereby the number of the first object is formed by adding or subtracting the numbers of the remainder of the at least three objects of the numerical addition and subtraction object series; and (e) crediting the at least one player if at least one of the numerical multiplication and division object series and the numerical addition and subtraction object series is formed.

According to the present invention, there is provided a method of playing a game with at least one player, the method comprising the steps of: (a) providing a plurality of objects, each object featuring a color and a number; (b) distributing at least three objects to the at least one player; (c) attempting to form at least one of a color object series and a numerical multiplication and division object series according to the colors and the numbers of the at least three objects, respectively, wherein the color object series is formed such that a first object features a color resulting from a linear combination of colors of a remainder of the at least three objects of the color object series, and wherein the numerical multiplication and division object series is formed such that a first object features a non-prime number and each object of a remainder of the at least three objects features a prime number or a fraction of a prime number, whereby the non-prime number of the first object is formed by multiplying or dividing the numbers of the objects of the remainder of the at least three objects of the numerical multiplication and division object series; and (d) crediting the at least one player if at least one of the color series and numerical multiplication and division object series is formed.

According to the present invention, there is provided a method of playing a game with at least one player, the method comprising the steps of: (a) providing a plurality of objects, each object featuring a color and a number; (b) distributing at least three objects to the at least one player; (c) attempting to form at least one of a color object series and a numerical addition and subtraction object series according to the colors and the numbers of the at least three objects, respectively, wherein the color object series is formed such that a first object features a color resulting from a linear combination of colors of a remainder of the at least three objects of the color object series, and wherein the numerical addition and subtraction object series is formed such that a first object features a number and each object of a remainder of the at least three objects features a number, whereby the number of the first object is formed by adding or subtracting the numbers of the remainder of the at least three objects of the numerical addition and subtraction object series; and (d) crediting the at least one player if at least one of the color object series and said numerical addition and subtraction object series is formed.

The method of the present invention features mathematical operations of numbers, and/or mathematical operations of colors, in the main objective of play. The method of playing a game of numbers and colors of the present invention can be implemented in alternative formats or media, for example, based on the use of cards, tokens, or a computer.

The game method of the present invention provides players with a more flexible alternative method of p laying a mathematical and color based game, whereby players perform mathematical operations on numbers (including prime numbers) and/or colors, using number and/or color objects (e.g., cards or computer images) which are privately possessed by each player (i.e., not viewable by all players), in combination with number and/or color objects accessible to all players. In this game method, a new higher level of player strategy is introduced by way of players privately possessing objects for the duration of the game, in contrast to existing mathematical game methods based on utilizing sets of cards or objects exposed to all players.

The present invention includes a new method of simultaneously combining mathematical operations performed on both numbers and colors. The method of playing a game of numbers and colors simultaneously amuses and educates participants with respect to number and color combinations, and serves as a new addition to currently existing game methods based on subjects of mathematics or color.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
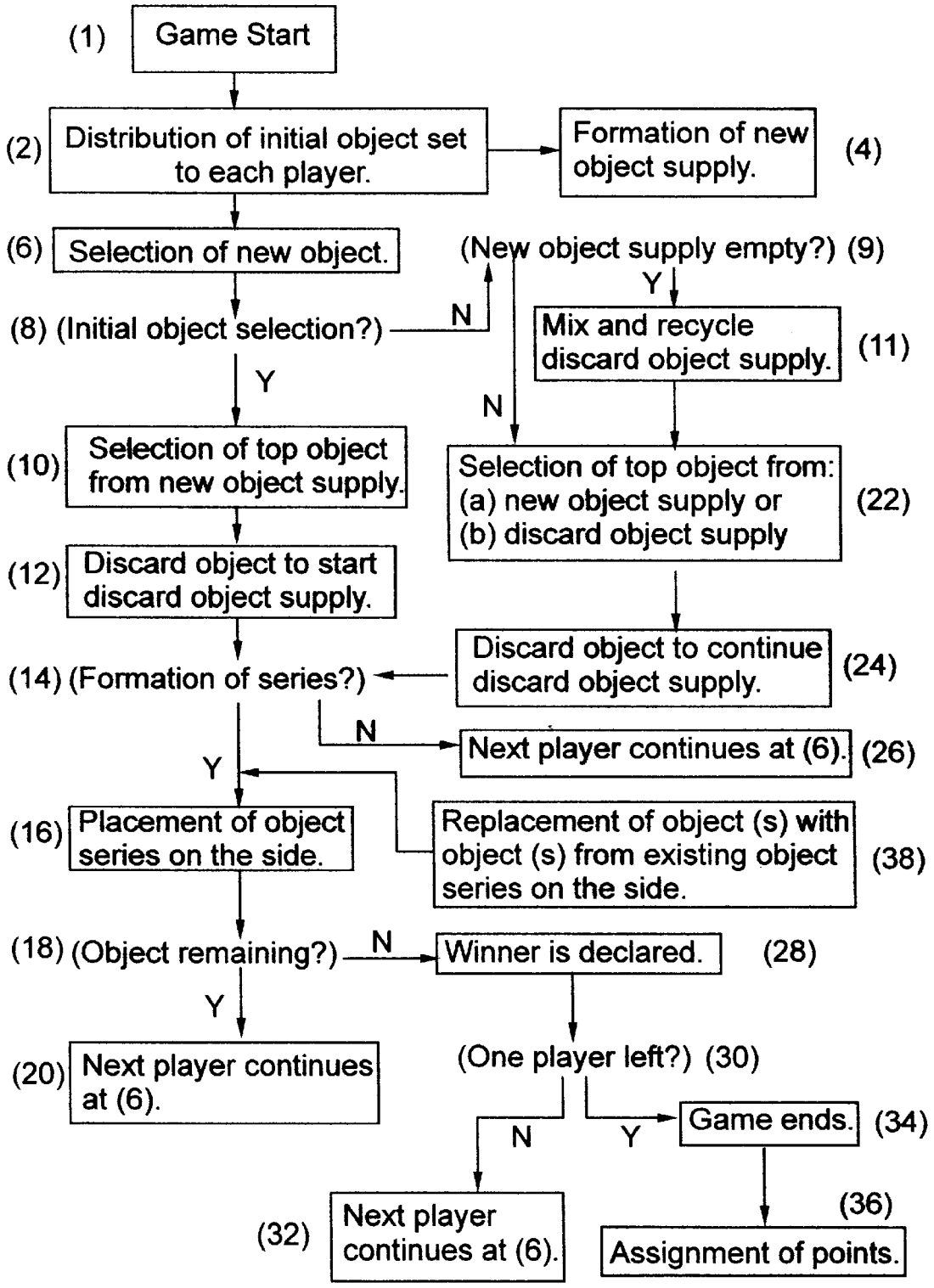
FIG. 1 is the flow chart of the method of playing the game of numbers and colors.

The present invention is of a method of playing a game of numbers and colors, which can be implemented using alternative formats or media. A main objective of the game of numbers and colors of the present invention is to form series of numbers and/or colors, using real objects (e.g., cards), or virtual objects (e.g., computer images), that are in the possession of each player, whereby each object features a color and at least one number, and upon which are performed specific mathematical operations.

In the present invention, an object series is either numerical or color based, and determined according to fulfillment of at least one of the mathematical operations of multiplication, division, addition, or subtraction. The multiplication or division operation is applied to a group of at least two prime numbers and one non-prime number. The addition or subtraction operation is applied to a group of at least three different numbers (prime and/or non-prime) and/or colors.

A numerical multiplication and division object series features at least three objects such that one object is numerated as a non-prime number and the remainder of the objects in the same object series are each numerated as prime numbers or fractions of prime numbers, whereby the product or division of the prime numbers and/or fractions of the prime numbers results in the non-prime number of that same object series. Any numerical object series, based on multiplication of numbers, can also be represented as an object series based on division of numbers, and vice versa, using the same numerical objects of that series, in an order consistent with the mathematical relationship between multiplication and division of a given set of numbers. The following five examples illustrate the formation of valid numerical multiplication and division object series, during implementation of the method of the game of numbers and colors of the present invention shown in FIG. 1. In the first example, a player in possession of three objects featuring the numbers 2, 3, and 6, can form a numerical object series, since 2 and 3 are prime numbers, whereby $2\times3=6$, the non-prime number of that object series. A second example is of a player in possession of four objects featuring the numbers 2, 3, 5, and 30, who can form a numerical object series, since 2, 3, and 5 are prime numbers, whereby $2\times3\times5=30$, the non-prime number of that object series. However, as a third example, a player in possession of three objects featuring the numbers 2, 4, and 8 cannot form a numerical object series, since 4 is not a prime number, although the objects determine the relation $2\times4=8$. In a fourth example, a player in possession of four objects featuring the numbers ½, ½, 3, and ¾, can form a numerical object series, since ½ is a fraction of a prime number, and 3 is a prime number, whereby $\frac{1}{2}\times\frac{1}{2}\times3=\frac{3}{4}$, the non-prime number of that object series. As a fifth example, a player in possession of three objects featuring the numbers ¼, ½, and ⅛, cannot form a numerical object series, since ¼ is not a fraction of a prime number, even though the objects determine the relation $\frac{1}{4}\times\frac{1}{2}=\frac{1}{8}$.

A numerical addition and subtraction object series features at least three objects such that one object features a number resulting from the addition or subtraction of the numbers of the remainder of the objects of that same numerical object series. Any numerical object series, based on addition of numbers, can also be represented as an object series based on subtraction of numbers, and vice versa, using the same numerical objects of that series, in an order consistent with the mathematical relationship between addition and subtraction of a given set of numbers. The following three examples illustrate the formation of valid numerical addition and subtraction object series, during implementation of the method of the game of numbers and colors of the present invention shown in FIG. 1. In the first example, a player in possession of five objects featuring the numbers 1, 3, 4, 7, and 14, can form a numerical object series, since $1+3+4+7=14$. In a second example, a player in possession of three objects featuring the numbers 13, 4, and 9, can form a numerical object series, since $13-4=9$. As a third example, a player in possession of three objects featuring the numbers ⅓, ½, and ⅚, can form a numerical object series, since $\frac{1}{3}+\frac{1}{2}=\frac{5}{6}$.

A color based linear combination (e.g., addition or subtraction) color object series features at least three objects such that one object features the color resulting from a linear combination (e.g., addition or subtraction) of the colors of the remainder of the objects of that same color object series. The following three examples illustrate the formation of valid color object series, based on, for example, addition or subtraction of colors, during implementation of the method of the game of numbers and colors of the present invention shown in FIG. 1. In the first example, a player in possession of three objects featuring the colors red, green, and yellow, can form a color object series, since red+green=yellow. In a second example, a player in possession of three color objects featuring the colors magenta, cyan, and blue, can form a color object series, since magenta+cyan=blue. As a third example, player in possession of three color objects featuring the colors cyan, green, and blue can form a color object series, since cyan−green=blue.

A single or double object series may be formed, whereby a single object series is either numerical (i.e., features numbers only) or color based (i.e, features colors only), and a double object series is both numerical and color based (i.e., simultaneously fulfilling the criteria of a numerical and a color object series), with game objects featuring both numbers and a color. Examples of single object series were provided above. An example of a double object series is of a player in possession of three objects, featuring 2—red, 3—green, and 5—yellow, whereby $2+3=5$, and red+green=yellow.

Once a player forms an object series (e.g., of cards, tokens, or computer images), a principle game task is complete. The player who forms object series of all objects possessed by him, is declared a winner of the game. The game is continued according to the same method until one player is left with objects not part of an object series.

The components and operation of a method of playing a game of numbers and colors according to the present invention are better understood with reference to the drawings and the accompanying description. It is to be noted that the drawings of the present invention shown here are for illustrative purposes only and are not meant to be limiting.

Referring now to the drawings, FIG. 1 illustrates the preferred embodiment of the flow chart of the method of playing the game of numbers and colors. The guide to understanding the flow chart of FIG. 1 is as follows: (1) An action step is a step in the game which requires the performance of an activity by a player; a short phrase indicative of each action step appears in a box, and is identified by a parenthesized number unique to that particular action step. (2) A decision step is a step prior to an action step, which requires a (Yes) or (No) answer to the indicated question, prior to a player performing the following action step. A decision step appears inside parentheses, and is identified by a parenthesized number unique to that particular decision step. (3) An alternative (Yes) or (No) answer to each particular decision step is indicated by a parenthesized upper case letter, (Y) or (N), and immediately follows each decision step. (4) Arrows indicate the logical direction and linkage between action and decision steps.

In FIG. 1, the game start (step 1) begins with distribution of initial object sets (step 2). An initial object set is distributed to each player, the number of objects in each object set being determined prior to the start of the game. Each player possesses an object set for the duration of the game, during which the number of objects in each player's object set varies as each player forms object series.

Figure 2:
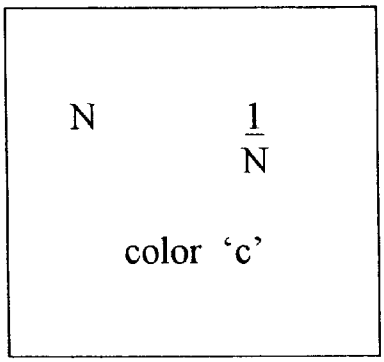
FIG. 2 is an illustration showing alternative designs of game objects.
Figure 2:
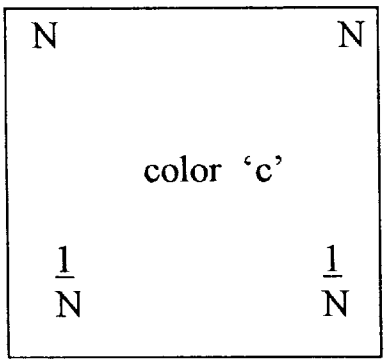
Figure 2:
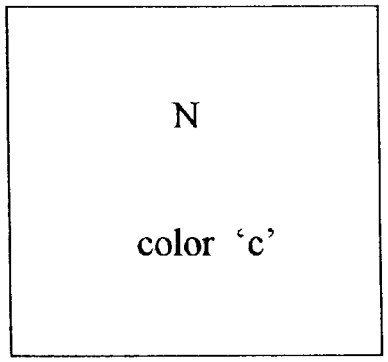
Figure 2:
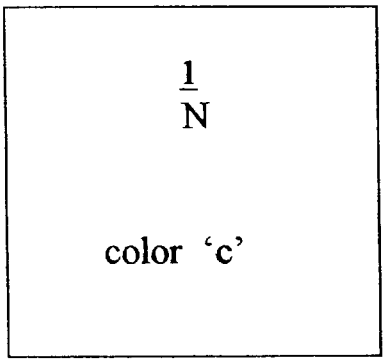
Figure 2:
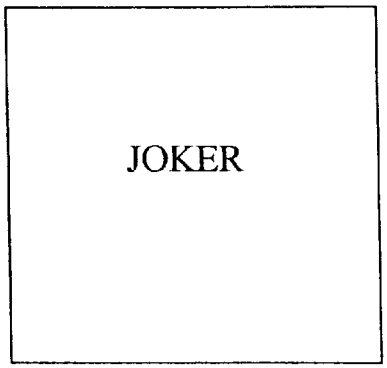

Game objects are comprised of real objects (e.g., cards), or virtual objects (e.g., computer images), and can be either two or three dimensional. Game objects are either ordinary or of joker type. Each ordinary game object features a color and at least one number. In a preferred embodiment of the present invention, each ordinary game object features a color, a number, and the reciprocal of that same number. FIG. 2 is an illustration showing alternative designs of game objects applicable for use with the present invention. The alternative designs of game objects illustrated in FIG. 2 are examples only, and are not meant to be limiting with respect to other alternative game object designs. In FIG. 2, N, and 1/N represent a number, and the reciprocal of that same number, respectively; color 'c' represents a color. The preferred design of ordinary game objects (FIG. 2(*a*)), features each object being colored with a color, and including one number and the reciprocal of that same number on one and the same side of an object having two dimensions (e.g., square cards or tokens). An alternative design of ordinary game objects (FIG. 2(*b*)), is where each object is colored with a color on each of two sides of the object, one number appears on one side of the object, and the reciprocal of that same number appears on the second side of the object, for an object having two dimensions. Another alternative design of ordinary game objects (FIG. 2(*c*)), is where each object is colored with a color, and including one number in each of two corners, and the reciprocal of that same number in the remaining two corners, whereby the color and numbers are all on one and the same side of an object having two dimensions. Joker type game objects can feature the word JOKER on each side of an object, having two dimensions, for example (FIG. 2(*d*)). Joker type game objects are used to replace any ordinary game object, in terms of object function. Joker type game objects are assigned a number and/or a color according to the need and choice of the player in possession of the joker. An example of the use of a joker type game object is in a double object series having three objects featuring 2—red, joker, and 5—yellow, whereby the numerical object series 2+3=5, and the color based object series red+green=yellow, are formed as a result of the joker used as an object featuring both a number and a color, 3—green.

Returning to the flow chart of the game method shown in FIG. 1, the number of players participating in the game of numbers and colors of the present invention is at least two. The number of objects in each initial object set distributed to each player (step 2) depends upon the number of players and the number of objects used in the game. In the preferred embodiment of the game of numbers and colors, each player is distributed between five and thirty objects. Fifteen objects are recommended for each player, for a game having four players, for example.

In the preferred embodiment of the present invention, the minimal number of objects used in the game is determined by the law of multiplication, as follows: For a given integer, N>0, there are P prime numbers, and N−P non-prime numbers. Each non-prime number can be represented as a multiplication of K prime numbers as $L=(P_1)\times(P_2) \ldots x (P_K)$, where L is a non-prime number, $P_i$ are all prime numbers for i=1, 2, . . . K, and x defines the multiplication operator. The total number of objects participating in the game is defined as M=N−P+V, where N−P is the total of all non-prime numbers, and V is the number of appearances of all prime numbers in all multiplications upto N, and including the prime numbers themselves.

Each player is assigned possession of an initial object set. For example, this may be in the form of each player physically holding his object set in his hand, or alternatively, each player has virtual possession of his object set via a computer terminal displaying the object set. Possession of the object set continues throughout the duration of the game, until the game ends. As shown in FIG. 1, all objects not used in the distribution of initial object sets to the players (step 2) are used to form the initial, new object supply (step 4) and are placed on the side for subsequent use in the game.

The game of numbers and colors of the present invention features players taking turns, one at a time, until the game comes to its logical conclusion. The first player to take a turn selects a new object (step 6). If this is the initial selection of an object (step 8, Yes), the player selects the top or first object from the new object supply (step 10). The same player then discards an object from his object set, i.e., either a different object or the object chosen from the new object supply, in order to start the discard object supply (step 12). The player then determines if his object set contains an object series (step 14). If an object series is formed (step 14, Yes), the player places that object series on the side (step 16). It is then determined if that same player has objects remaining in his object set (step 18). If that player has objects remaining in his object set (step 18, Yes), the next player continues the game (step 20), with selection of a new object (step 6).

If player selection of a new object is not an initial selection (step 6, No), the initial object supply is checked that it is not empty (step 9). If the new object supply is not empty (step 9, No), the player selects an object (step 22) from either (a) the new object supply of (step 4), or (b) the top object added to the discard object supply by the former player via (step 12 or step 24). If the new object supply is empty (step 9, Yes), the current discard object supply is mixed and recycled to continue the new object supply (step 11). The player then selects an object (step 22) from either (a) the new object supply of (step 4), or (b) the discard object supply. The same player discards an object (step 24), either a different object already in the player's possession, the object chosen from the new object supply, or from the discard object supply, in order to continue the discard object supply. If an object series is formed (step 14, Yes), the player places that object series on the side (step 16), and if that player has objects remaining in his object set (step 18, Yes), the next player continues the game (step 20), with selection of a new object (step 6).

Following selection of a new object (step 6), and discarding of an object (step 12), if the player cannot form an object series (step 14, No), the next player continues the game (step 26), with selection of a new object (step 6). Following formation of an object series (step 14, Yes), if a player has no objects remaining in his object set (step 18, No), a winner is declared (step 28). Following declaration of a winner (step 28), if there is more than one player remaining in the game (step 30, No), the remaining players either (a) continue playing the game with the next player (step 32), with selection of a new object (step 6), or, (b) end the game (step 34), and assign points to each player (step 36). Following declaration of a winner (step 28), if one player is left in the game (step 30, Yes), the game ends (step 34), and points are assigned to each player (step 36).

During the game, following any single complete round of play by all players, a special case of a player replacing one or more objects of an object series previously formed and placed on the side (step 14, Yes and step 16), with one, and only one, object from that same player's object set, is permissible (step 38). Two criteria which must be met for replacement of objects are: (1) the object series, previously formed and placed on the side (step 14, Yes and step 16) must be maintained, i.e., as numerical or as color, and (2) following replacement of objects (step 38), the player must use the replaced object(s) of the object series previously formed and placed on the side to form a new object series from that same player's object set, and simultaneously place that new object series on the side (step 16).

A player has three options available with respect to replacing an object or objects of a previously formed object series. In the first option, a player can replace an object featuring a prime number, already part of one of that same player's previously formed numerical (i.e., multiplication, division, addition, or subtraction) series with an object from that same player's object set, featuring the same prime number but featuring a different color. An example of this option is of a player who previously formed the numerical object series featuring the objects 2—green, 3—blue, and 6—red, whereby 2×3=6, and possesses in his current object set, the object featuring 2—red, among a non-specified number of objects. That same player now needs an object featuring the color green in order to form a new color object series featuring red, green, and yellow. The player can replace the object featuring 2—red with the object featuring 2—green, whereby the previously formed numerical object series 2—green, 3—blue, and 6—red becomes 2—red, 3—blue, and 6—red, whereby the numerical object series is maintained as 2×3=6, and the new color object series formed from the player's current object set is red, green, and yellow, whereby, red+green=yellow, and that this new color series can be simultaneously placed on the side.

In the second option, a player can replace an object featuring a color, already part of one of that same player's previously formed color series with an object from that same player's object set, featuring the same color but featuring a different number (i.e., prime or non-prime). An example of this option is of a player who previously formed the color object series featuring the objects 3—blue, 5—red, and 10—magenta, whereby blue+red=magenta, and possesses in his current object set, the object featuring 8—red, among a non-specified number of objects. That same player now needs an object featuring the number 5 in order to form a new numerical object series featuring 2, 3, and 5. The player can replace the object featuring 5—red with the object featuring 8—red, whereby the previously formed color object series 3—blue, 5—red, and 10—magenta becomes 3—blue, 8—red, and 10—magenta, whereby the color object series is maintained as blue+red=magenta, and the new numerical object series formed from the player's current object set is 2, 3, and 5, whereby, 2+3=5, and that this new numerical series is to be simultaneously placed on the side.

In the third option, a player can replace one or more objects featuring prime numbers, already part of one of that same player's previously formed numerical series with a single object from that same player's object set, featuring a non-prime number, irrespective of featured color. Following replacement of objects (step 38), the player must use the replaced object(s) of the previously formed object series to form a new object series from that same player's object set, and simultaneously place that new object series on the side (step 16).

For a player using the third option of object replacement, in the case of replacing numerical objects of a previously formed numerical multiplication and division object series, the new numerical multiplication and division object series already on the side, formed by replacement of an object taken from that same player's object set, can be changed to feature at least three numbers, whereby, one object features a non-prime number and the rest of the objects in that particular numerical multiplication and division object series are not required to feature prime numbers or fractions of prime numbers (i.e., the replaced objects may feature non-prime numbers). This case of object replacement represents an exception to the rule of forming numerical multiplication and division object series, in which the newly formed numerical multiplication and division object series features more than one non-prime number.

An example of the third option of object replacement is of a player who previously formed the numerical multiplication object series having objects featuring the numbers 2, 3, 3, and 18, whereby 2×3×3=18, and possesses in his current object set, the objects featuring the numbers 3, 6, and 9, among a non-specified number of objects. That same player now needs an additional object featuring the number 3 in order to form a new numerical multiplication object series featuring the numbers 3, 3, and 9. The player can replace the objects featuring 2 and 3, with the single object featuring 6, whereby the previously formed numerical multiplication object series 2, 3, 3, and 18 becomes 6 and 3, whereby the numerical multiplication object series is maintained as 6×3=18, and the new numerical multiplication object series formed from the player's current object set is 3, 3, and 9, whereby, 3×3=9, and that this new numerical series is to be simultaneously placed on the side.

Following the game end (step 34), assignment of game points (step 36) to each player is done, involving two stages. In stage 1, the initial object point score is determined, whereby each object of a single series (i.e., numerical or color) is valued as one point, and each object of a double series (i.e., numerical and color) is valued as two points. Each player's initial object point score is obtained by summation of all of that player's object points. In stage 2, the final point score is determined, whereby, each player's final point score is obtained by adding to that player's initial object point score, the final point score of all successive winners, such that, the first winner's final point score includes the final point score of all other players. The second winner's final point score includes the final point score of all other players, exclusive of the first winner's final point score, and so on, whereby the last player's final point score is based only on that player's initial object point score.

In the case that a winner is declared (step 28) with more than one player remaining in the game (step 30, No), and the players decide to end the game (step 34) (i.e., not continue to play the game (step 32) as is optional if there remains more than one player at the time of declaration of the winner), the final point score of that same winner is assigned by adding to the sum of that winner's initial object point score, the sum of the initial object point scores of the remaining players.

Four examples of assignment of game points follow. (1) A player having formed a numerical multiplication object series featuring the numbers 2, 3, 5, and 30, for example, receives four object points, one point for each object featuring a number part of the series. (2) A player having formed a color object series featuring the colors red, blue, and magenta, for example, receives 3 object points, 1 point for each object featuring a color of the series. (3) A player having formed a numerical and color object series featuring the objects 2—red, 2—green, and 4—yellow, for example, receives 6 object points, 2 points for each object featuring a number and color of both series. (4) The winner of a completed game of numbers and colors received 25 initial object points from adding the points of all of his object series. The second winner of the same completed game received 30 initial object points from adding the points of all of his object series. The third player, and the last to complete the same game received 25 initial object points from adding the points of all of his object series. Accordingly, the final point score of the winner, the second, and third player, are 80, 55, and 25, respectively.

In example (4), for the case that a first and only winner was declared with two other players remaining in the game, and the players decide to end the game, the final point score of the first and only declared winner is 80, and the final point scores of the two other players are 30 and 25, respectively. In this case of game end, there is no second winner, as such, assignment of the final point score to each remaining player is based only on the first stage of point assignment, which corresponds only to the initial object point score of each remaining player.

Figure 3:
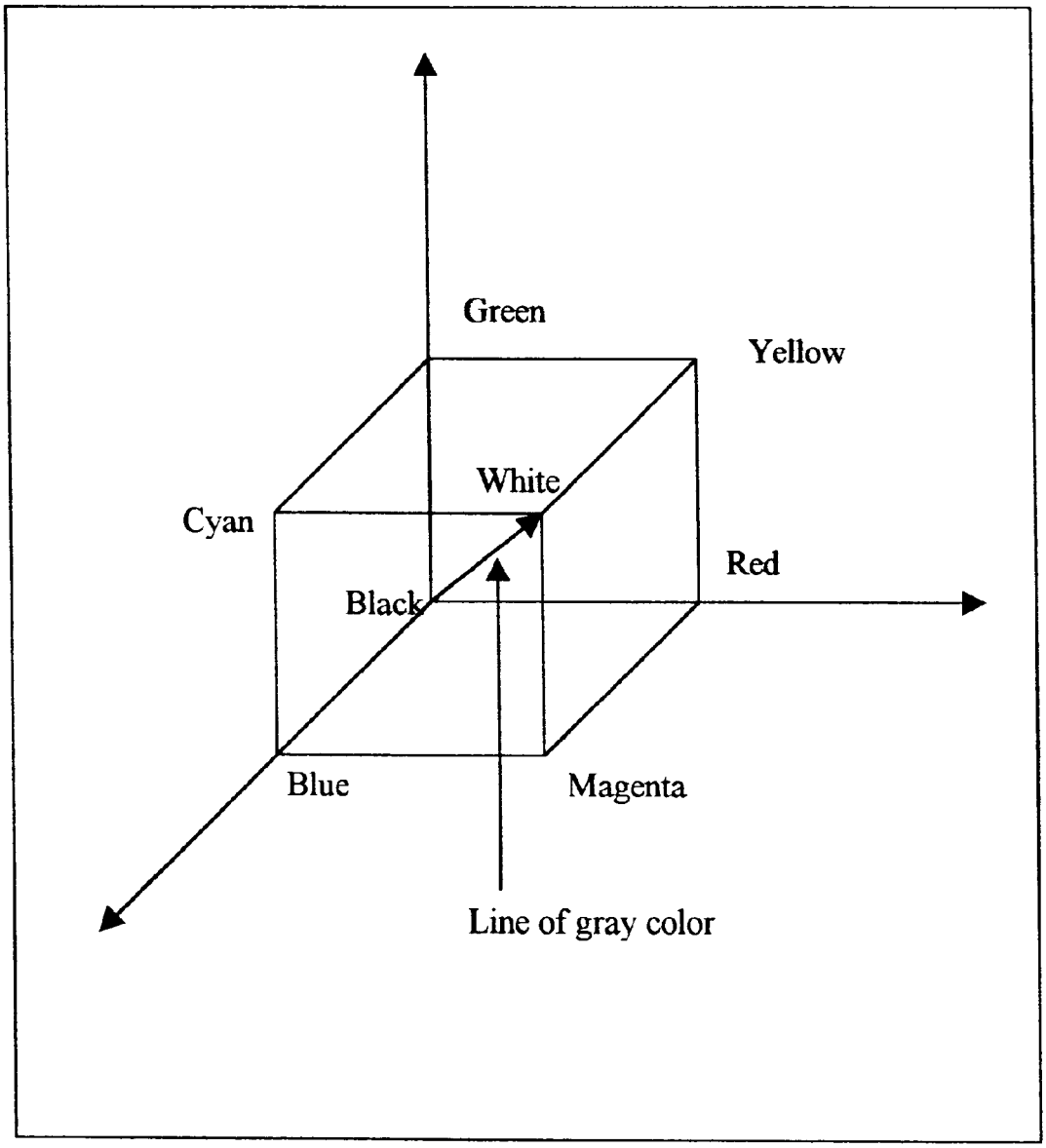
FIG. 3 is an illustration showing the relationships among the colors red green, blue, white, cyan, magenta, yellow, and black.

FIG. 3 is an illustration showing the relationships among the colors red, green, blue, white, cyan, magenta, yellow, and black. The basic colors are red, green, and blue; the complementary basic colors are cyan, magenta, and yellow, respectively. Each color can be represented as a vector positioned in three dimensional color space. For a given two dimensional plane featuring three basic colors (i.e., excluding black and white), each basic color is bounded between two other basic colors, such that each basic color can be represented as a linear combination (i.e., addition and subtraction) of the vectors of the two other basic colors located in that same two dimensional plane. The six, two dimensional planes of basic colors are: green, cyan, and yellow; magenta, blue, and red; cyan, green, and blue; red, yellow, and magenta; yellow, green, and red; blue, and magenta, and cyan. In the embodiment of the present invention, preference is given to usage of the basic colors in the design of game objects, for the purpose of forming color based object series. Examples of linear combinations of basic colors include: red+green=yellow, magenta+cyan=blue, and cyan−green=blue. In FIG. 3, black is determined when color saturation is minimal, and white is determined when color saturation is maximal.

While the invention has been described with respect to one embodiment, it will be appreciated that many variations, modifications and other applications of the invention may be made.

What is claimed is:

1. A method of playing a game with at least one player, the method comprising the steps of:

(a) providing at least three objects, each object featuring a color;

(b) distributing at least three objects to the at least one player;

(c) attempting to form a color object series from said at least three objects, wherein said color object series is formed such that a first object of said color object series features a color resulting from adding or subtracting of at least two different colors of a remainder of said at least three objects part of said color object series; and (d) crediting the at least one player if said color object series is formed.

2. The method of claim 1, wherein said each object additionally features at least one number, further comprising the steps of:

(e) attempting to form a numerical object series from said at least three objects, wherein said numerical object series is formed such that a first object of said numerical object series features a number resulting from performing a mathematical operation selected from the group consisting of multiplication, division, addition, and subtraction, on numbers of a remainder of said at least three objects part of said numerical object series; and (f) crediting the at least one player if said numerical object series is formed.

3. The method of claim 2, further comprising the steps of:

(g) declaring a winner when the at least one player no longer possesses at least one object;

(h) ending said game when said a winner can no longer be declared; and (i) assigning final points to each of the at least one player.

4. The method of claim 2, wherein said numerical object series is a numerical multiplication and division object series formed such that a first object of said numerical multiplication and division object series features a non-prime number and each object of said remainder of said at least three objects part of said numerical multiplication and division object series features a prime number or a fraction of a prime number, whereby said non-prime number of said first object results from multiplying or dividing said numbers of said objects of said remainder of said at least three objects part of said numerical multiplication and division object series.

5. The method of claim 2, wherein said numerical object series is a numerical addition and subtraction object series formed such that a first object of said numerical addition and subtraction object series features a number resulting from adding or subtracting said numbers of said remainder of said at least three objects part of said numerical addition and subtraction object series.

6. The method of claim 2, further comprising the steps of:

(g) attempting to form a double object series from said at least three objects, said double object series featuring simultaneously a color object series and a numerical multiplication and division object series, wherein said color object series is formed such that a first object of said double object series features a color resulting from adding or subtracting of at least two different colors of a remainder of said at least three objects part of said double object series, and wherein said numerical multiplication and division object series is formed such that said first object of said double object series features a non-prime number and each object of said remainder of said at least three objects part of said double object series features a prime number or a fraction of a prime number, whereby said non-prime number of said first object results from multiplying or dividing said numbers of said objects of said remainder of said at least three objects part of said double object series; and (h) crediting the at least one player if said double object series featuring simultaneously said color object series and said numerical multiplication and division object series is formed.

7. The method of claim 2, further comprising the steps of:

(g) attempting to form a double object series from said at least three objects, said double object series featuring simultaneously a color object series and a numerical addition and subtraction object series, wherein said color object series is formed such that a first object of said double object series features a color resulting from adding or subtracting of at least two different colors of a remainder of said at least three objects part of said double object series, and wherein said numerical addition and subtraction object series is formed such that said first object of said double object series features a number resulting from adding or subtracting numbers of said remainder of said at least three objects part of said double object series; and (h) crediting the at least one player if said double object series featuring simultaneously said color object series and said numerical addition and subtraction object series is formed.

8. The method of claim 1, wherein the game is played by a plurality of players including a first player and a second player, the method further comprising the steps of:

(e) forming a new object supply from remainder of objects following the step of distributing at least three objects to said first player;

(f) selection of the top object from said new object supply by said first player;

(g) forming a discard object supply by said first player discarding an object selected from the group consisting of said at least three objects and said top object from said new object supply;

(h) placing said color object series on the side;

(i) if said first player possesses at least one object, said second player selects the top object from the group consisting of said new object supply and said discard object supply;

(j) attempting to form said color object series by said second player;

(k) crediting said second player if said color object series is formed;

(l) declaring a winner when one of said plurality of players no longer possesses said at least one object;

(m) alternatively, ending said game if said winner is not declared; and (n) assigning a final point score to each of said plurality of players.

9. The method of claim 8, wherein the step of assigning said final point score to each of said plurality of players is done in two stages, whereby in stage one, an initial object point score is determined, whereby each of said at least three objects of said color object series is valued as one point, and said initial object point score is obtained by summation of all of said points of each of said plurality of players, and whereby in stage two, said final point score is obtained by adding said final point score of each of the remainder of said plurality of players to said initial object point score, such that said final point score of a winner includes said final point scores of all of said plurality of players.

10. The method of claim 8, further comprising the step of:

(o) if said new object supply is empty, mixing and recycling said discard object supply to produce said new object supply.

11. A method of playing a game with at least one player, the method comprising the steps of:

(a) providing at least three objects, each said object featuring a number;

(b) distributing at least three said objects to the at least one player;

(c) attempting to form a double object series from said at least three objects, said double object series featuring simultaneously a color object series and a numerical multiplication and division object series, wherein said color object series is formed such that a first object of said double object series features a color resulting from adding or subtracting of at least two different colors of a remainder of said at least three objects part of said double object series, and wherein said numerical multiplication and division object series is formed such that said first object of said double object series features a non-prime number and each object of said remainder of said at least three objects part of said double object series features a prime number or a fraction of a prime number, whereby said non-prime number of said first object results from multiplying or dividing said numbers of said objects of said remainder of said at least three objects part of said double object series; and (d) crediting the at least one player if said double object series featuring simultaneously said color object series and said numerical multiplication and division object series is formed.

12. The method of claim 11, wherein said each object features a color and more than one number.

13. The method of claim 12, wherein a plurality of players play the game, the method further comprising the step of:

(e) declaring a winner when at least one of said plurality of players no longer possesses said at least one object.

14. A method of playing a game with at least one player, the method comprising the steps of:

(a) providing at least three objects, each said object featuring a number;

(b) distributing at least three said objects to the at least one player;

(c) attempting to form a double object series from said at least three objects, said double object series featuring simultaneously a color object series and a numerical addition and subtraction object series, wherein said color object series is formed such that a first object of said double object series features a color resulting from adding or subtracting of at least two different colors of a remainder of said at least three objects part of said double object series, and wherein said numerical addition and subtraction object series is formed such that said first object of said double object series features a number resulting from adding or subtracting said numbers of said remainder of said at least three objects part of said double object series; and (d) crediting the at least one player if said double object series featuring simultaneously said color object series and said numerical addition and subtraction object series is formed.

15. The method of claim 14, wherein said each object features a color and more than one number.

* * * * *